US005479149A

United States Patent [19]

Pike

[11] Patent Number: 5,479,149

[45] Date of Patent: Dec. 26, 1995

[54] WEAPON USE MONITORING AND RECORDING SYSTEM

[76] Inventor: Glenn D. Pike, 6509 Cannon Ave., Guntersville, Ala. 35976

[21] Appl. No.: 385,787

[22] Filed: Feb. 9, 1995

[51] Int. Cl.[6] ..... G08B 21/00; G08B 3/10

[52] U.S. Cl. ..... 340/539; 340/568; 340/573; 340/574

[58] Field of Search ..... 340/568, 573, 340/574, 539

[56] References Cited

U.S. PATENT DOCUMENTS

| | | | |
|---|---|---|---|
| 3,530,451 | 9/1970 | Devine | 340/568 |
| 3,750,131 | 7/1973 | Fletcher et al. | 340/574 |
| 4,284,985 | 8/1981 | Heger et al. | 340/539 |
| 4,936,037 | 6/1990 | Holcomb et al. | 42/106 |
| 5,108,019 | 4/1992 | Woodward et al. | 224/243 |
| 5,196,825 | 3/1993 | Young | 340/573 |
| 5,218,344 | 6/1993 | Ricketts | 340/573 |
| 5,365,217 | 11/1994 | Toner | 340/574 |

*Primary Examiner*—Glen Swann
*Attorney, Agent, or Firm*—Jacobson, Price, Holman & Stern

[57] ABSTRACT

The system includes a receiver/recorder/transmitter carried by the officer which can be activated by a manual switch or a sensor switch associated with the weapon holster and weapon to record and transmit a signal indicating removal of the weapon from the holster and record and transmit all audible sounds, conversations and the like that occur in the vicinity of the officer. The information that is received by the receiver/recorder/transmitter carried by the officer is transmitted to a receiver/recorder/transmitter in the officer's patrol car which receives the information from the transmitter carried by the officer, records and transmits it with a longer range signal to a dispatch station. The information transmitted to the dispatch station will energize an audible or visual signal to alert the dispatcher of a possible life threatening situation being encountered by the officer with the information transmitted to the dispatcher being recorded and logged in to enable the dispatcher to send assistance or back up officers if deemed necessary. The officer's weapon also includes a sensing and signal transmitting device that will transmit a signal to enable the officer's weapon to be located in the event it is taken from the officer's holster or from the officer by an unauthorized person to facilitate recovery of the weapon and possibly the arrest of the person who took the weapon from the officer.

12 Claims, 2 Drawing Sheets

WEAPON USE MONITORING AND RECORDING SYSTEM

BACKGROUND OF THE INVENTION

1. Field of the Invention

A system is disclosed by which the activities of and conditions encountered by a law enforcement officer are monitored, transmitted to a dispatch station and recorded. The system includes a receiver/recorder/transmitter carried by the officer which can be activated by a manual switch or a sensor switch associated with the weapon holster and weapon to record and transmit a signal indicating removal of the weapon from the holster and record and transmit all audible sounds, conversations and the like that occur in the vicinity of the officer. The information that is received by the receiver/recorder/transmitter carried by the officer is transmitted to a receiver/recorder/transmitter in the officer's patrol car which receives the information from the transmitter carried by the officer, records and transmits it with a longer range signal to a dispatch station. The information transmitted to the dispatch station will energize an audible or visual signal to alert the dispatcher of a possible life threatening situation being encountered by the officer with the information transmitted to the dispatcher being recorded and logged in to enable the dispatcher to send assistance or back up officers if deemed necessary. The officer's weapon also includes a sensing and signal transmitting device that will transmit a signal to enable the officer's weapon to be located in the event it is taken from the officer's holster or from the officer by an unauthorized person to facilitate recovery of the weapon and possibly the arrest of the person who took the weapon from the officer.

2. Description of the Prior Art

Various efforts have been made to provide alarm devices that are activated by removal of a weapon from a holster and to provide a signal producing device associated with a weapon to assist in locating the weapon.

The following U.S. Patents relate to this field of endeavor.

U.S. Pat. No. 3,530,451

U.S. Pat. No. 4,936,037

U.S. Pat. No. 5,108,019

U.S. Pat. No. 5,218,344

U.S. Pat. No. 3,530,451 discloses the broad concept of providing an alarm device that includes a sensing device in the form of a reed switch associated with a holster to activate the alarm device upon removal of a weapon from the holster. The sensing device activates a radio transmitter when the weapon is removed from the holster to send a signal to a remote station indicating that a law enforcement officer's weapon has been removed from the holster.

U.S. Pat. No. 4,936,037 discloses a radio transmitter concealed within the confines of a weapon for transmitting conversations or other audio conditions to a remote station with the information being transmitted being recorded at the remote station. U.S. Pat. No. 5,108,019 discloses an audible alarm activated in response to disconnecting a flexible weapon retaining strap on a holster. U.S. Pat. No. 5,218,344 discloses a personnel movement monitoring system for replacing the use of two way radios and the like.

While various alarm devices are known, the prior art does not disclose a system equivalent to that disclosed in this application.

SUMMARY OF THE INVENTION

An object of the present invention is to provide a system for monitoring and recording weapon use by a law enforcement officer in which a receiver/recorder/transmitter carried by the law enforcement officer is activated in response to weapon removal from the holster or by actuation of a manual switch to record and transmit that the weapon has been removed from the holster and/or all audible voices and other audible conditions in the immediate vicinity of the law enforcement officer.

A further object of the invention is to provide a system as defined in the preceding object in which the information transmitted by the officer carried recorder and transmitter is received and recorded and transmitted from a receiver, recorder and transmitter in the patrol car which the law enforcement officer may have left to investigate a situation or pursue a suspect.

A further object of the invention is to provide a system in accordance with the preceding objects in which the information transmitted from the patrol car is received in a dispatch station with the information transmitted activating an audible and/or visual alarm to alert a dispatcher with all of the incoming information being recorded, the officer involved identified, the date and time and other information recorded by a dispatcher thereby enabling a dispatcher to send assistance which may be needed by the law enforcement officer who may be faced with a life threatening situation and to enable verification of all information at a later date in the event such verification becomes necessary.

Still another object of the invention is to provide a system in accordance with the above objects in which the weapon is provided with a signal transmitting device which enables the movement of the weapon to be tracked and location of the weapon to be determined in the event the weapon is separated from the law enforcement officer in order to locate the weapon and possibly result in the arrest of a suspect.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENT

Figure 1:
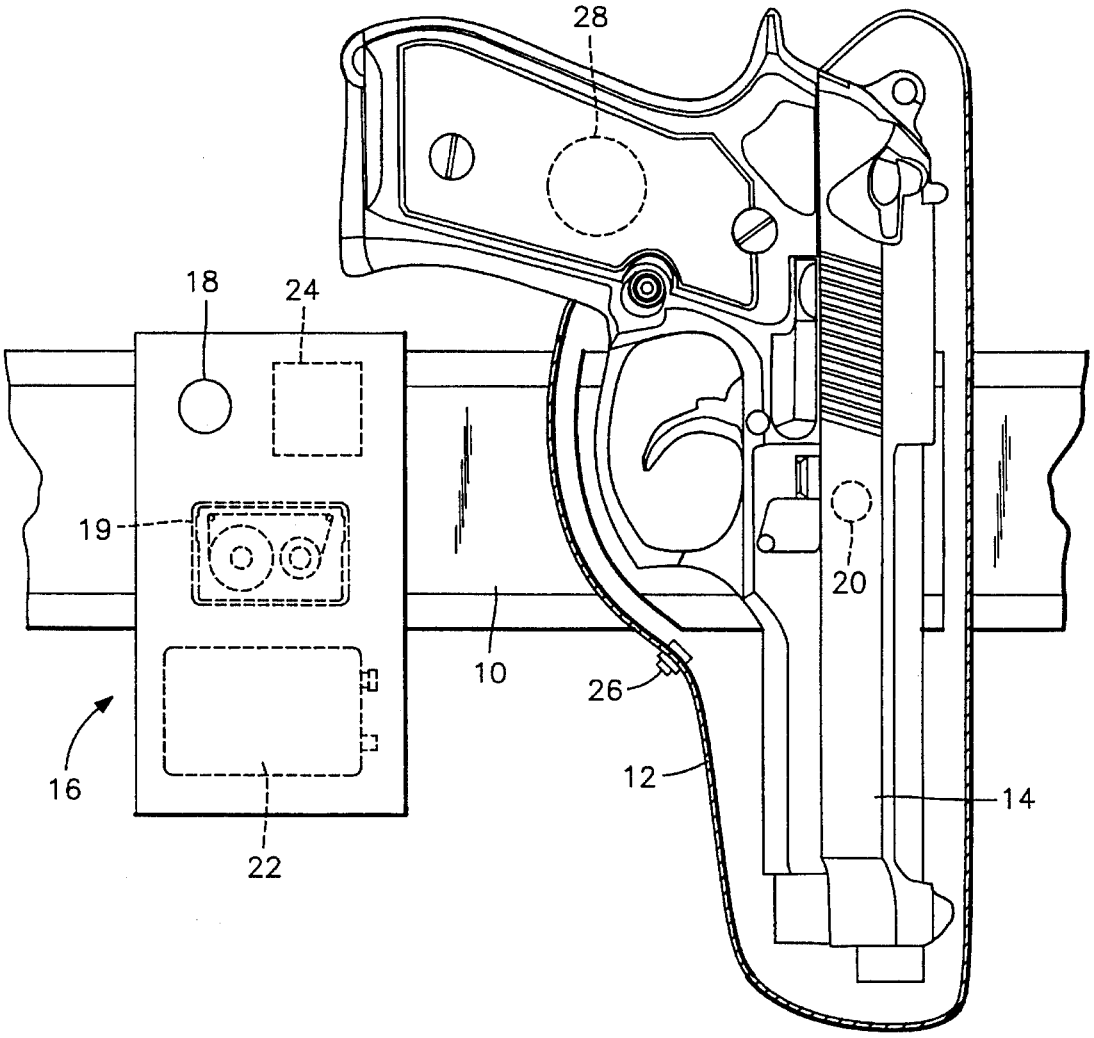
FIG. 1 is a schematic elevational view of a holster, weapon and supporting belt illustrating schematically the components of the system associated with the law enforcement officer.
Figure 2:
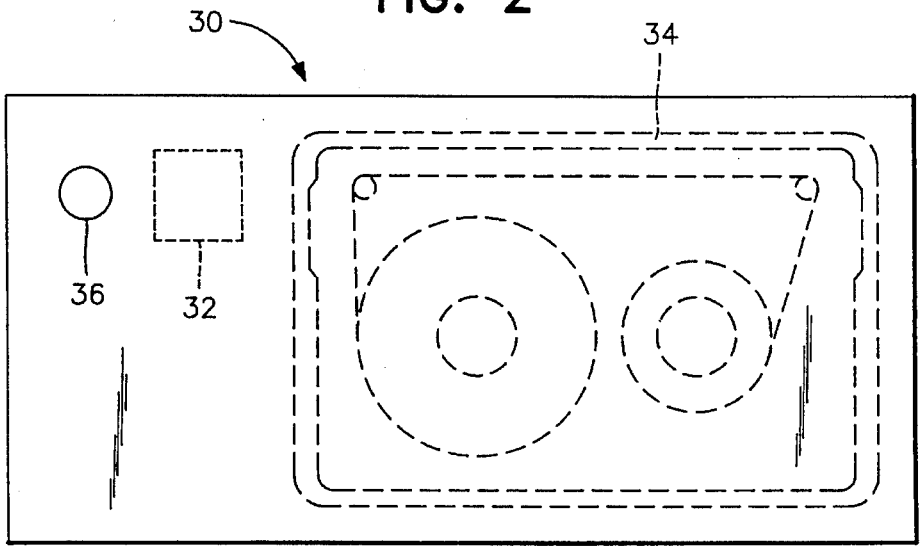
FIG. 2 is a plan view schematically illustrating the components of the system mounted in a patrol car.

In the drawings, FIG. 1 illustrates the components of the system that is worn by the law enforcement officer including a supporting belt 10 having a holster 12 attached thereto for a weapon 14. The structure of the belt and the attachment of the holster as well as the shape and configuration of the holster is conventional and the weapon is of conventional shape and size normally used by law enforcement officers.

Attached to the belt is a receiver/transmitter/recorder unit 16 having an audio receiver or microphone 18 incorporated therein and including a tape recorder 19 therein which will record all audible sounds and conversations picked up by the microphone or receiver 18 which may be a voice actuated tape recorder or the tape recorder may be actuated only when a switch is closed. The holster is provided with a sensor or sensing unit 20 which is a small, water resistant sensing unit located in or behind the holster 12 which senses the presence or absence of the weapon 14. When the weapon is removed from the holster, the sensing unit 20 will close a circuit to energize the receiver/recorder/transmitter by virtue of the sensing unit 20 including a switch in an electrical circuit which includes a battery 22 in the recorder/transmitter to connect the power source to the receiver/recorder/transmitter. The recorder, transmitter includes a transmitting unit 24 incorporated therein which is energized along with the receiver/recorder for transmitting a radio signal whenever the weapon 14 is removed from the holster 12 or whenever a manually operated switch 26 mounted on the holster or belt in a concealed but readily accessible position is closed which also connects the battery to the receiver/recorder/transmitter. With this construction, a signal indicating removal of the weapon is received, recorded and transmitted when the weapon is removed and all audible conversations or other sounds are also received, recorded and transmitted when the weapon is removed from the holster. Also, the switch 26 can be manually actuated to close the circuit to the receiver/recorder/transmitter for recording and transmitting all audible conversations and other sounds adjacent the law enforcement officer even though the weapon remains in the holster.

In addition, the weapon 14 includes a transmitter 28 which will automatically transmit a signal enabling the weapon 12 to be tracked or located anytime that it is removed from the holster. In the event the weapon 14 is taken from the holster by the law enforcement officer or an unauthorized person, the transmitter 28 will transmit a signal to enable the weapon to be located. If an unauthorized person gains possession of the weapon and leaves the area of the law enforcement officer, the weapon can be tracked and ultimately located by following the signal transmitted by the transmitter 28 incorporated into the weapon in any convenient location where it is not observable to an unauthorized person. This frequently enables the location of the weapon to be determined which sometimes can assist in the arrest of a suspect who has gained unauthorized possession of the weapon.

All information and signals received by the receiver 18 and recorded by the recorder 19 is transmitted by the transmitter 24 to a relay receiver/recorder/transmitter generally designated by reference numeral 30 located in a patrol car that the law enforcement officer may have left in the pursuit of a suspect. This unit is mounted in the patrol car in any convenient location such as on the dashboard and receives all signals and information transmitted by the transmitter 24. This unit includes a receiver 32 receiving all signals and information from the transmitter 24, a recorder 34 to record all information and a transmitter 36 to relay and transmit all information and signals received from the transmitter 24 to a base alert module 38 with the recorder 34 being activated to record all information received by the receiver 32 which also may record any voice conversations or sound conditions at or adjacent the patrol car as well as receiving signals and information from the transmitter 24.

Figure 3:
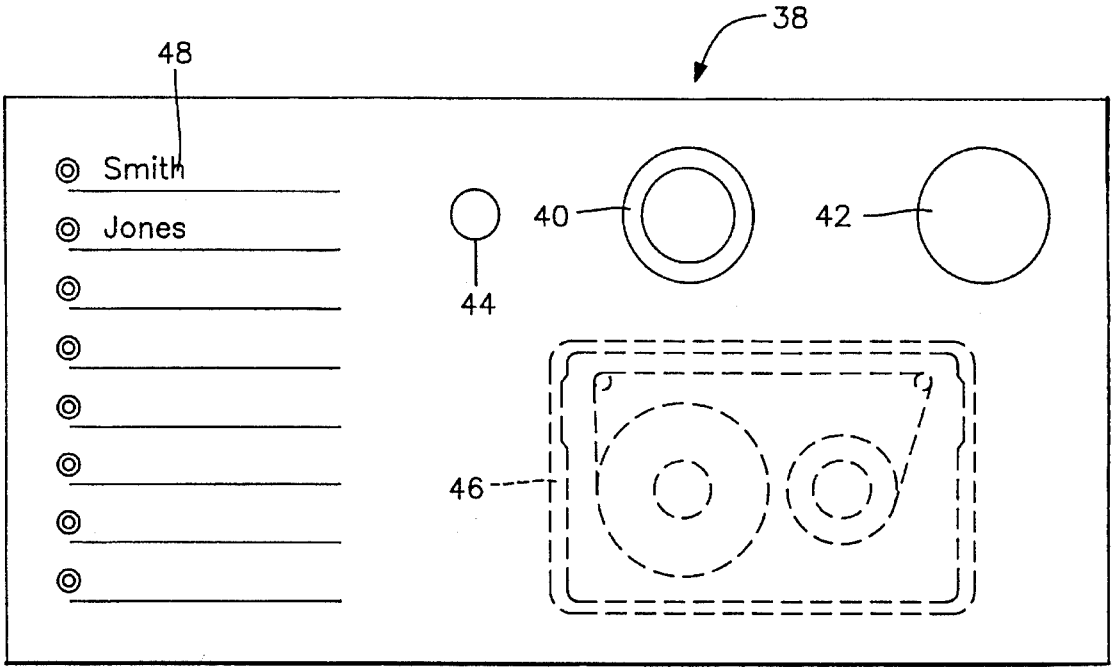
FIG. 3 is a plan view schematically illustrating the components at a dispatcher's station.
Figure 4:
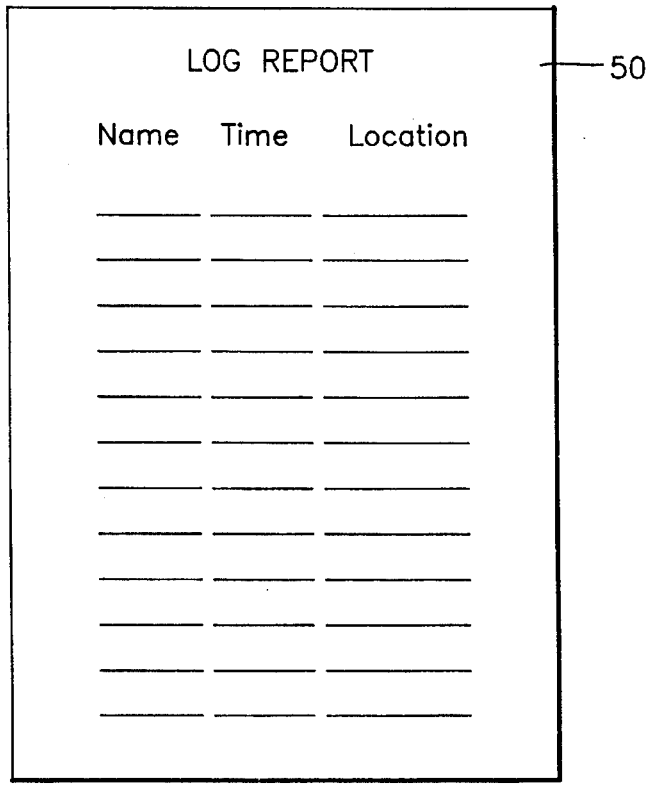
FIG. 4 is a plan view illustrating a log report completed by a dispatcher.

FIG. 3 illustrates the base module 38 located at a central dispatching station or the like and includes a visual signal 40, an audible signal 42 and a receiver 44 for receiving all signals and other information transmitted by transmitter 36. Thus, when a weapon is drawn, the sensing unit will alert the dispatcher at the dispatching station that the law enforcement officer may be faced with a life threatening situation to enable the dispatcher to dispatch assistance or backup to the law enforcement officer. Also, all information transmitted by the transmitters 24 and 32 will be received and recorded by a recorder 46 at the base module 38. Also, the law enforcement officer may be identified and the name of the officer recorded by indicia 48 placed on the base alert module 38. Also, a log report 50 may be completed by the dispatcher in which the name, time and location of each incident recorded can be entered into the log.

This system provides the capability of verifying what actually occurred "after the incident" to enable supervisors to monitor when and where as well as why a weapon was drawn which is beneficial information that can be used during and after the situation occurs. The information collected can be used for training, verification of facts and avoiding litigation. Most importantly, it enables a law enforcement officer to quickly summon help even though the officer may not be able to call for such help on conventional radio equipment that the officer may be carrying or that may be in the patrol car. The manual switch 26 enables the transmission of information without the knowledge of a person conversing with the law enforcement officer. Each law enforcement officer and the associated patrol car will operate on the same frequency. However, each patrol car transmitting to the dispatcher station will have a separate frequency in order to enable the dispatcher to determine which patrol car is transmitting the signal and information and where that patrol car is located. The signal transmitter 28 in the weapon may not only indicate the location of the weapon but also indicate when the weapon was cocked or fired.

The components of the system cooperate so that the manual switch 26 or sensor switch 20 will transmit signals and information transmitted from the transmitter 24, to be received, recorded and relayed to the base alert module 38 through the receiver, recorder, transmitting relay unit 30 mounted in the patrol car. This information is relayed to and recorded at the base alert module 38 and the dispatcher is alerted to a possible life threatening situation and can direct assistance to the law enforcement officer or take other appropriate action. The built in signaling device or transmitter 28 enables the weapon to be tracked and located if it leaves the area occupied by the law enforcement officer.

The components incorporated into this system are conventional with the components worn by the law enforcement officer being battery powered along with the weapon location transmitter 28. The components located in the patrol car are connected to the vehicle battery to supply power since the transmitter in the patrol car may require more power to transmit a greater distance than the transmitter carried by the officer.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A system for monitoring and recording weapon use by a law enforcement officer comprising a weapon holster supported on the body of a law enforcement officer, a weapon normally supported in said holster, an audio receiving, recording and transmitting unit including a battery power source supported from a law enforcement officer, weapon sensing switch means associated with said holster for energizing the receiving, recording and transmitting unit when the weapon is removed from the holster, said receiving, recording and transmitting unit supported by a law enforcement officer transmitting a signal indicating removal of the weapon from the holster, all audible conversations, and all audible sounds adjacent a law enforcement officer to a base module operated by a dispatcher at a location remote from the transmitting unit supported by a law enforcement officer to alert the dispatcher that a weapon has been removed from the holster to enable a dispatcher to send assistance to the law enforcement officer if necessary.

2. The system as defined in claim 1 together with a relay unit mounted in a patrol car in the proximity of a law enforcement officer on which the receiving, recording and transmitting unit are supported, said relay unit including a receiver, recorder and transmitter for receiving all information provided by the transmitting unit supported by the law enforcement officer and relaying that information to said base module.

3. The system as defined in claim 2 wherein said base module includes a receiver, recorder and alert signal receiving information from the relay unit, said alert signal indicating to a dispatcher that information is being transmitted from the relay unit.

4. The system as defined in claim 3 wherein said base module includes an audio output to enable the dispatcher to review all information transmitted from the relay unit.

5. The system as defined in claim 4 wherein a log unit is provided at the base module to enable a dispatcher to log in information as to the patrol car in which the relay unit is mounted and identify the law enforcement officer having said supported holster.

6. The system as defined in claim 5 wherein said weapon includes a tracking signal transmitter actuated upon removal of the weapon from the holster to enable the weapon to be tracked in the event the location of the weapon changes either by movement of the law enforcement officer or by movement of a person gaining unauthorized possession of the weapon.

7. The system as defined in claim 6 together with a manual switch supported from a law enforcement officer to energize the receiving, recording and transmitting unit supported by a law enforcement officer at any time without regard to removal of said weapon from said holster.

8. The system as defined in claim 1 wherein said weapon includes a tracking signal transmitter actuated upon removal of the weapon from the holster to enable the weapon to be tracked in the event the location of the weapon changes either by movement of the law enforcement officer or by movement of a person gaining unauthorized possession of the weapon.

9. The system as defined in claim 1 together with a manual switch supported from a law enforcement Officer to energize the receiving, recording and transmitting unit supported by a law enforcement officer at any time without regard to removal of said weapon from said holster.

10. A system for monitoring and recording weapon use by a law enforcement officer comprising a weapon holster supported on the body of a law enforcement officer, a weapon normally supported in said holster, an audio receiving and transmitting unit including a battery power source supported from the law enforcement officer, weapon sensing switch means associated with said holster for energizing the receiving and transmitting unit when the weapon is removed from the holster, said receiving and transmitting unit supported by the law enforcement officer transmitting a signal indicating removal of the weapon from the holster, all audible conversations, and all audible sounds adjacent the law enforcement officer to a base module operated by a dispatcher at a location remote from the transmitting unit supported by the law enforcement officer to alert the dispatcher that a weapon has been removed from the holster to enable a dispatcher to send assistance to the law enforcement officer if necessary.

11. The system as defined in claim 10 together with a relay unit mounted in a patrol car in the proximity of the law enforcement officer on which the receiving and transmitting unit are supported, said relay unit including a receiver and transmitter for receiving and transmitting all information provided by the transmitting unit supported by the law enforcement officer and relaying that information to said base module.

12. A system for monitoring and recording all sounds and conversations adjacent a law enforcement officer comprising an audio receiving and transmitting unit including a battery power source supported from the law enforcement officer, switch means associated with said battery power source and said receiving and transmitting unit for energizing the receiving and transmitting unit when the switch means is closed, said receiving and transmitting unit supported by the law enforcement officer receiving and transmitting all audible conversations and all audible sounds adjacent the law enforcement officer, a relay unit mounted in a patrol car in the proximity of the law enforcement officer on which the receiving and transmitting unit are supported, said relay unit including a receiver and transmitter for receiving and transmitting all information provided by the transmitting unit supported by the law enforcement office and a base module at a dispatcher station at a location remote from the transmitting unit supported by the law enforcement officer and remote from the relay unit transmitter, said base module including a receiver and recorder for receiving and recording all information transmitted by the transmitter at the relay unit, said base module including an alert signal indicating to a dispatcher that information is being transmitted from the relay unit.

* * * * *